United States Patent [19]

Parsons

[11] Patent Number: 4,961,408

[45] Date of Patent: Oct. 9, 1990

[54] PISTONS FOR RECIPROCATING MACHINES

[75] Inventor: Bryan N. V. Parsons, Stoney Stanton, United Kingdom

[73] Assignee: Jaguar Cars Limited, England

[21] Appl. No.: 378,023

[22] Filed: Jul. 11, 1989

[30] Foreign Application Priority Data

Jul. 16, 1988 [GB] United Kingdom ..... 8816981

[51] Int. Cl.[5] ..... F02F 3/00

[52] U.S. Cl. ..... 123/193 P; 92/190

[58] Field of Search ..... 123/193 P; 92/252, 255, 92/195, 196, 216

[56] References Cited

U.S. PATENT DOCUMENTS

| | | | |
|---|---|---|---|
| 1,279,184 | 9/1918 | Vincent | 92/216 |
| 1,795,353 | 3/1931 | Taylor | 92/190 |
| 2,113,628 | 4/1938 | Pillar | 92/216 |
| 3,552,276 | 1/1971 | Morrow | 92/195 |
| 4,358,881 | 11/1982 | Mahrus et al. | 92/190 |
| 4,508,019 | 4/1985 | Kabele et al. | 92/215 |

FOREIGN PATENT DOCUMENTS

| | | |
|---|---|---|
| 319945 | 10/1929 | United Kingdom . |
| 418651 | 11/1934 | United Kingdom . |

*Primary Examiner*—E. Rollins Cross

*Attorney, Agent, or Firm*—Davis, Bujold & Streck

[57] ABSTRACT

A piston has a head portion and a skirt formation, a gudgeon pin by which the piston may be pivotally connected to a connecting rod is supported transversely of the skirt formation, the skirt formation is defined by a pair of part cylindrical skirt portions, the gudgeon pin connecting the skirt portions together and interengaging formations are provided on the head portion and skirt portions to locate the skirt portions axially with respect to the head portion.

12 Claims, 1 Drawing Sheet

PISTONS FOR RECIPROCATING MACHINES

BACKGROUND TO THE INVENTION

The present invention relates to pistons for reciprocating machines, for example, internal combustion engines or pumps.

Conventionally, pistons are formed in one piece defining a head portion and skirt formation, bushes being provided in the skirt formation for engagement of a gudgeon pin by means of which the piston may be pivotally connected to a connecting rod.

SUMMARY OF THE INVENTION

According to one aspect of the present invention, a piston comprises a head portion and a pair of part cylindrical skirt portions, a gudgeon pin connecting the part cylindrical skirt portions together and means being provided to locate the skirt portions axially with respect to the head portion.

In pistons of the above construction, the head portion and skirt portions may be made of dissimilar materials, for example, the head portion which is subjected to high temperature variations may be made of a ceramic material, while the skirt portions may be made of conventional alloy materials.

In our co-pending U.S. patent application claiming convention priority from UK patent application No. 8816983.4 we disclose a piston construction in which the head portion is formed asymmetrically of the skirt portion, so that the head portion may be maintained in engagement with one side of the cylinder wall, while accommodating thermal exansion of the head portion. In this construction, expansion of the head portion will result in tilting of the piston within the cylinder bore, and the piston must be designed accordingly. An alternative solution to this problem would be to use a piston in accordance with the present invention, the head portion being permitted to float laterally relative to the skirt portions to accommodate expansion of the head portion and means being provided to resiliently bias the head portion into engagement with one side of the cylinder.

The skirt portions of the present invention may also be resiliently urged apart and into engagement with the cylinder wall, thereby reducing backlash. In this case, it would be advantageous to contour the skirt portions so that they engage the bore of the cylinder only at angularly spaced positions, said positions preferably being symmetrically arranged transversely opposed to the axis of the gudgeon pin.

An embodiment of the invention is now described, by way of example only, with reference to the accompanying drawings, in which:

DESCRIPTION OF A PREFERRED EMBODIMENT

Figure 1:
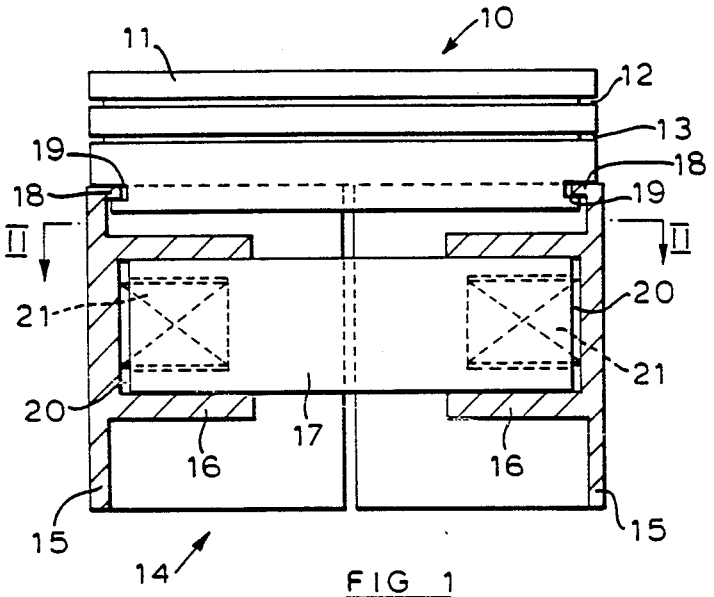
FIG. 1 is a sectional side elevation of a piston formed in accordance with the present invention.
Figure 2:
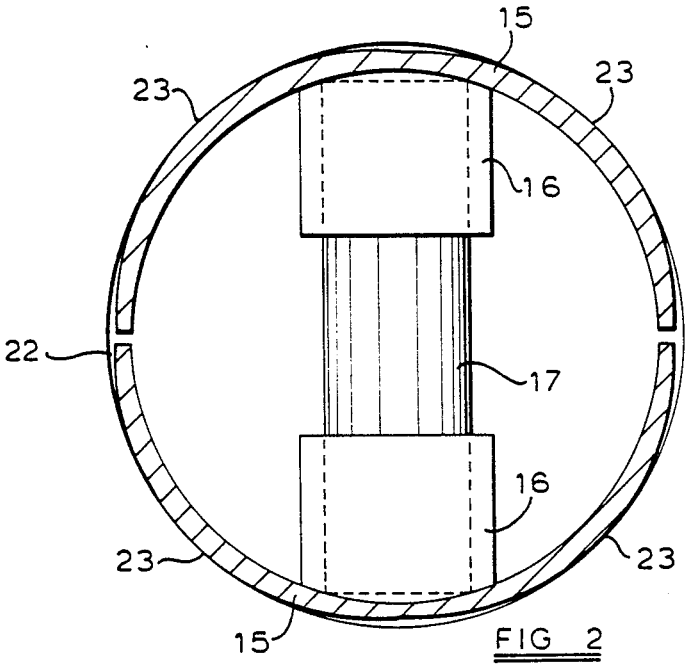
FIG. 2 is a section along the line II—II of FIG. 1.

The piston 10 illustrated in FIGS. 1 and 2 comprises a piston head portion 11 having a pair of circumferential grooves 12 and 13 in which a piston ring and oil control ring (not shown) may be located in conventional manner.

Skirt 14 of the piston 10 is formed from two semi-cylindrical skirt portions 15. Each skirt portion 15 defines a bearing formation 16 in which a gudgeon pin is slidingly located. A connecting rod (not shown) may also be pivotally mounted on the gudgeon pin 17 intermediate of the bearing formations 16, in conventional manner.

The upper ends of the skirt portions 15 are provided with inwardly directed flange formations 18 which engage in a circumferential groove 19 adjacent the lower end of piston head portion 11 to locate the skirt portion 15 axially of the head portion 11.

Spring/damper units 21 act between the gudgeon pin 17 and the closed ends 20 of bearing formation 16, so that the skirt formations 15 are urged outwardly and, when the piston 10 is located within a cylindrical bore 22, into engagement with the walls of the cylinder bore 22.

The semi-cylindrical skirt portions 15 each have a section the outer surface of which is defined by two eccentric quarter circles, so as to provide high spots 23 which engage the bore 22 of the cylinder at angularly spaced locations symmetrically of the bearing formations 16. Contact between the skirt portions 15 and the bore 22 and the frictional engagement therebetween, is thereby reduced.

Resiliently loading and damping the skirt portions 15 into engagement with the bore 22 of the cylinder, will reduce backlash or piston slap consequently improving engine wear and reducing the noise emmisions of the engine.

In the above embodiment, the head portion 11 may be formed from a plain cylindrical blank and the grooves 12, 13 and 19 may be machined therein. It is consequently possible to make the head portion 11 of, for example, a ceramic or refractory material and the skirt portions may be made from alloy materials used conventionally to produce pistons.

The circumferential groove 19 is preferably made of sufficient depth to permit some relative movement between the head portion 11 and the skirt portions 15, so that the latter may move outwardly to engage the cylinder bore 22 and accommodate any wear therein. Under normal conditions, the piston head 11 will be centred in the bore 22 of the cylinder by means of the piston ring. Alternatively, the head portion 11 may be loaded resiliently with respect to the skirt portions 15 so that it is symmetrical or offset from the skirt portions 15, as desired.

I claim:

1. A piston comprising a head portion and a pair of part cylindrical skirt portions, a gudgeon pin connecting the part cylindrical skirt portions together and means being provided to locate the skirt portions axially with respect to the head portion, the skirt portions being contoured to provide high spots which will engage a cylinder bore at angularly spaced locations.

2. A piston according to claim 1 in which each skirt portion defines a bearing formation in which the gudgeon pin is slidingly located.

3. A piston according to claim 1 in which each skirt portion is provided with a radially inwardly directed flange formation, the flange formation of each skirt portion engaging in a circumferential groove in the head portion to locate the skirt portions axially of the head portion.

4. A piston according to claim 3 in which the head portion is able to float laterally relative to the skirt portions.

5. A piston according to claim 4 in which means is provided to bias the head portion centrally of the skirt portions.

6. A piston according to claim 4 in which means is provided to bias the head portion asymmetrically of the skirt portions.

7. A piston according to claim 1 in which the skirt portions are biassed away from one another.

8. A piston according to claim 7 in which resilient means act between the gudgeon pin and each of the bearing formations to urge the skirt portions apart.

9. A piston according to claim 7 in which damping means is provided to control movement of the skirt portions.

10. A piston according to claim 1 in which the high spots are disposed at angularly spaced locations asymmetrically of the bearing formations.

11. A piston comprising a head portion and a pair of part cylindrical skirt portions, a gudgeon pin connecting the part cylindrical skirt portions together and means being provided to locate the skirt portions axially with respect to the head portion, in which the head and skirt portions are made of dissimilar material.

12. A piston according to claim 11 in which the head portion is made of a ceramic or refractory material.

* * * * *